US005966778A

United States Patent [19]

Ray

[11] Patent Number: 5,966,778

[45] Date of Patent: Oct. 19, 1999

[54] DOOR POSITIONING HINGE

[76] Inventor: Billy Jack Ray, 3445 Fuchsia St., Costa Mesa, Calif. 92626

[21] Appl. No.: 09/030,695

[22] Filed: Feb. 25, 1998

[51] Int. Cl.[6] ..... E05D 11/06; E05C 17/64

[52] U.S. Cl. ..... 16/374; 16/338; 16/262

[58] Field of Search ..... 16/374, 375, 380, 16/82, 332, 338, 342, 262; 292/DIG. 15, DIG. 17, 340, 341.18; 411/393, 908

[56] References Cited

U.S. PATENT DOCUMENTS

| | | | |
|---|---|---|---|
| 516,546 | 3/1894 | McCauley | 16/374 |
| 1,455,550 | 5/1923 | Rodell | 16/374 |
| 2,990,572 | 7/1961 | Schwartberg | 16/374 |
| 3,178,762 | 4/1965 | Whiting | 16/374 |
| 3,501,993 | 3/1970 | Swenson | 411/393 |
| 3,707,014 | 12/1972 | Koivusalo | 16/52 |
| 3,832,755 | 9/1974 | Maertin et al. | 16/156 |
| 5,813,809 | 9/1998 | Russum | 411/393 |

FOREIGN PATENT DOCUMENTS

| | | | |
|---|---|---|---|
| 748919 | 5/1956 | United Kingdom | 411/393 |

*Primary Examiner*—Chuck Y. Mah
*Attorney, Agent, or Firm*—Blakely, Sokoloff, Taylor & Zafmann LLP

[57] ABSTRACT

A door hinge featuring a first plate, a second plate and a position mechanism. The first plate and the second plate are interlocked to form multiple tubular members along a longitudinal side of the plates. These tubular members are adapted for insertion of a removable hinge pin therethrough. At least one of the tubular members includes an aperture to receive the position mechanism which applies additional frictional forces along the hinge pin to maintain a door in a stationary position.

8 Claims, 3 Drawing Sheets

DOOR POSITIONING HINGE

BACKGROUND OF THE INVENTION

I. Field of the Invention

The present invention relates to the field of mechanical hardware. More specifically, the present invention relates to a door hinge capable of maintaining a door in a stationary position.

II. Background of Art Related to the Invention

Typically, doors are attached to a door jam through two or more conventional door hinges. Each of these conventional door hinges includes two (2) metal plates in which a first metal plate is attached to the door jam and a second metal plate is attached to the door. Both metal plates have one or more members extending from one of their longitudinal edges. These members are curved to form tubular members. After attaching one metal plate to the door jam and the other metal plate to the edge of the door and interlocking the tubular members, a hinge pin is inserted therethrough. As a consequence, once all the door hinges are in place, the door is able to pivotally swing along a predetermined horizontal direction.

On occasion, a door may tend to accidentally close or swing open on its own. Normally, this action is caused from a slight misalignment of the door frame due to improper installation of the door, slight movement of the metal plates or perhaps settling of the foundation of a dwelling over time. In lieu of incurring the cost of re-installing the door, a door stopper may be wedged between the bottom latitudinal edge of the door and the ground in order to keep the door from closing. Alternatively, in those cases where door stoppers are ineffective, other rudimentary techniques may be used such as placing a household item between a longitudinal edge of the door and the door jam.

In light of the foregoing discussion, it is contemplated that there exists a need for a door hinge having an adjustable mechanism to maintain the door in any selected stationary position.

SUMMARY OF THE INVENTION

The present invention relates to a door hinge comprising a first plate, a second plate and a position mechanism. The first plate and the second plate include multiple tubular members extending along a longitudinal side of the plates. These tubular members are interlocked for insertion of a removable hinge pin therethrough. At least one of the tubular members includes an aperture to receive the position mechanism to provide additional frictional forces along the hinge pin.

BRIEF DESCRIPTION OF THE DRAWINGS

The features and advantages of the present invention will become apparent from the following description of the present invention in which.

DETAILED DESCRIPTION OF THE INVENTION

In the following detailed description, specific details of a positioning door hinge are set forth such as selective placement of an adjustable position mechanism and the like. However, it is apparent to one skilled in the art that the present invention may be practiced without the specific details set forth below.

Figure 1:
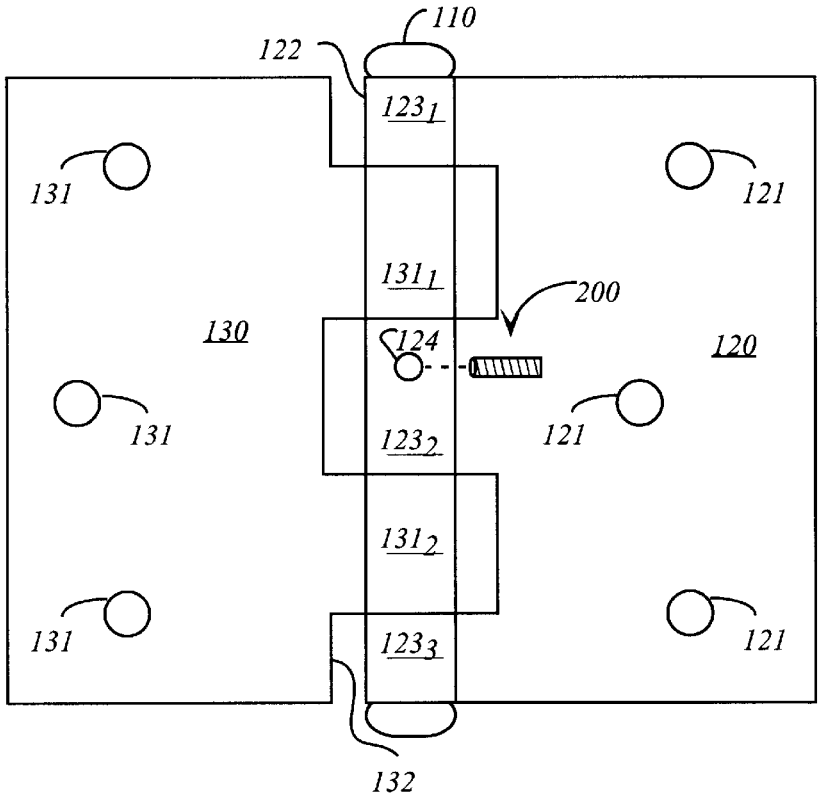
FIG. 1 is a perspective view of a first exemplary embodiment of the positioning door hinge.

Referring to FIG. 1, a perspective view of a first exemplary embodiment of a positioning door hinge 100 is described. Positioning door hinge 100 includes a hinge pin 110, a first plate 120 and a second plate 130. Both first plate 120 and second plate 130 include a plurality of pre-drilled holes 121 and 131, respectively. Herein, first plate 120 would be mounted to a door jam by wood screws inserted through pre-drilled holes 121 and embedded into the door jam. Second plate 130 would be mounted to a door by wood screws inserted through pre-drilled holes 131 and embedded into a longitudinal edge of the door. However, it is contemplated that positioning door hinge 100 is reversible so that first plate 120 may be attached to the door while second plate 130 is attached to the door jam.

Figure 3:
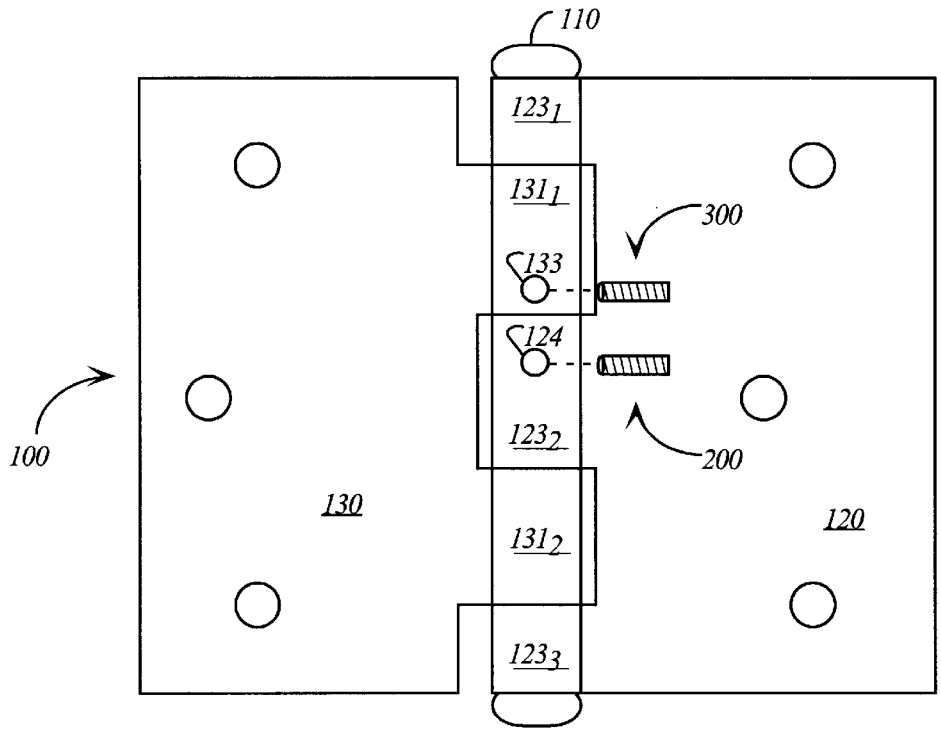
FIG. 3 is a perspective view of a second exemplary embodiment of the positioning door hinge.
Figure 5:
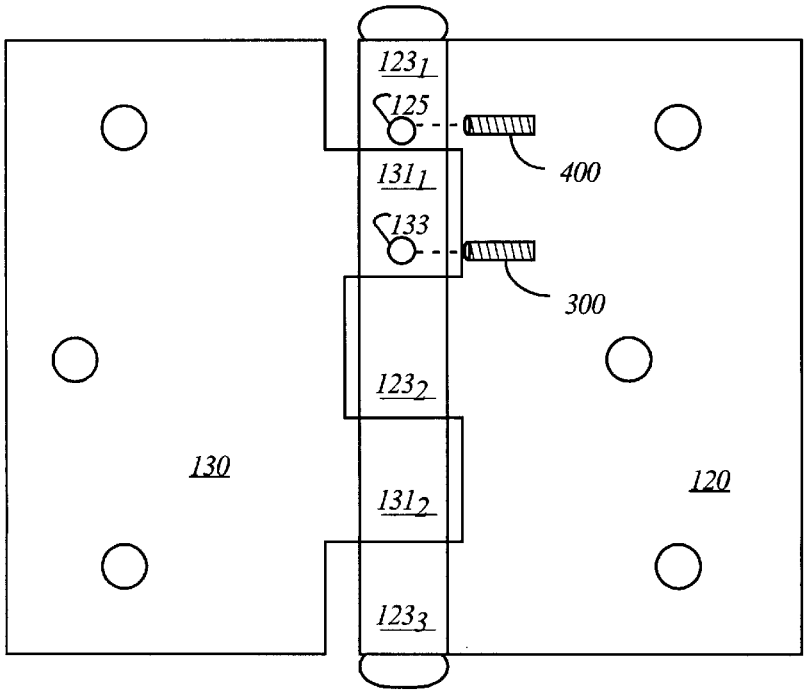
FIG. 5 is a perspective view of a third exemplary embodiment of the positioning door hinge.

As further shown, first plate 120 includes "n" members ("n" being a positive whole number; n=3 herein) extending along one of its longitudinal edge 122. These members are interspersed and curved at their end to form tubular members $\mathbf{123}_1$–$\mathbf{123}_3$. Unlike conventional door hinges, one or more of these tubular members (e.g., tubular member $\mathbf{123}_2$) may include an aperture 124. The aperture 124 may be pre-drilled and tapped threaded to allow an adjustable position mechanism 200 to come into contact with hinge pin 110 when hinge pin 110 is inserted through tubular members $\mathbf{123}_1$–$\mathbf{123}_3$. Similarly, second plate 130 includes "m" interspersed tubular members $\mathbf{131}_1$–$\mathbf{131}_m$ ("m" also being a positive whole number; m=2 herein) extending from a longitudinal edge 132. In lieu of or in combination with aperture 124, one or more of tubular members $\mathbf{131}_1$-$\mathbf{131}_2$ (e.g., tubular member $\mathbf{131}_1$) may include other apertures to provide contact with hinge pin 110 when inserted as shown in FIGS. 3 and 5.

Figure 2:
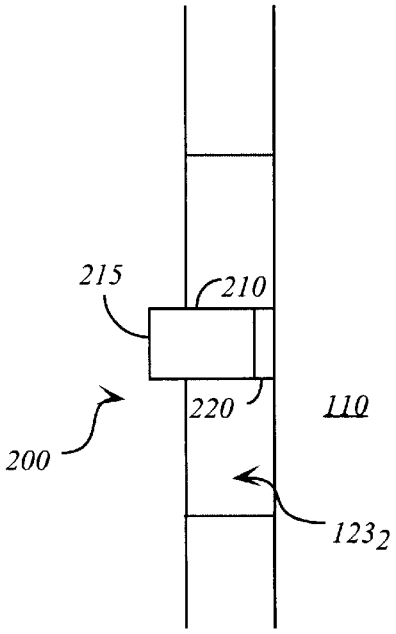
FIG. 2 is a cross-sectional view of an adjustable position mechanism to prevent rotation of a hinge pin inserted through the tubular members formed by the members of the plates of the positioning door hinge of FIG. 1.

Referring now to FIG. 2, a first exemplary embodiment of the adjustable position mechanism 200 of FIG. 1 is shown. Position mechanism 200 includes a generally cylindrical insert 210 compatible with aperture 124 of FIG. 1. The aperture 124 may be threaded and sized to accommodate insert 210 which would be complementary threaded. As a result, during use, insert 210 would be generally flush against the surface of its tubular member $\mathbf{131}_1$ to avoid effecting the movement or function of the hinge. Herein, insert 210 may be completely removed from aperture 124, but it is contemplated that insert 210 may be configured to allow adjustment so as to be physically separated from hinge pin 110 of FIG. 1 but partially retained in aperture 124.

As shown in FIG. 2, insert 210 includes a head 215 at one end and a pad 220 at the other end. Head 215 may be configured with a slot pattern for a conventional screwdriver, a cross pattern for a Phillips screwdriver, or another geometric pattern for any selected tool. Affixed to the end of insert 210 opposite head 215, the pad 220 is made of nylon, plastic or any other selective material. The material may be chosen for its wear-resistance, coefficient of friction and other important characteristics. The purpose of position mechanism 200 is to make contact with the hinge pin 110 of FIG. 1 in order to apply an additional frictional force against hinge pin 110. This additional force would maintain the door in a stationary position until an individual repositions the door to another stationary location. This amount of frictional force applied against hinge pin 110 would be sufficient to maintain the door from unwanted movement, but positioning mechanism 200 may be further tightened to increase the frictional forces applied against hinge pin 110 so that a substantial amount of force such as a firm push must be applied to move the door from its stationary position.

It is contemplated that other embodiments for position mechanism 200 may be used, including but not limited or restricted to (i) threaded insert 210 made of plastic in its entirety in order to avoid the need for pad 220, (ii) a plastic, nonthreaded insert sized for insertion into a non-grooved aperture 124 to act as a plug, or (iii) insert 210 made of metal without pad 220.

Figure 4:
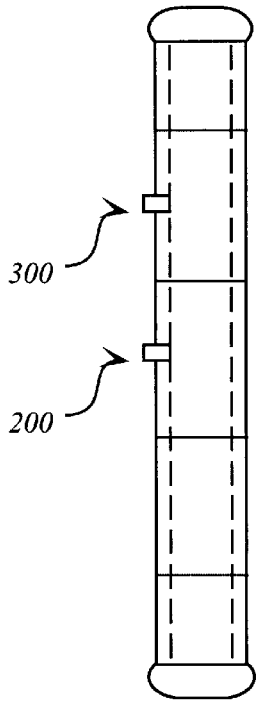
FIG. 4 is a more detailed cross-sectional view of the position mechanism of FIG. 2.

Referring to FIG. 3, a perspective view of a second exemplary embodiment of a positioning door hinge 100 is described. Similar to FIG. 1, positioning door hinge 100 includes a hinge pin 110, a first plate 120 including tubular members $\mathbf{123}_1$–$\mathbf{123}_3$ extending from longitudinal edge 122 and a second plate 130 including tubular members $\mathbf{131}_1$-$\mathbf{131}_2$ extending from a longitudinal edge 132 and interspersed with tubular members $\mathbf{123}_1$–$\mathbf{123}_3$. Herein, at least one of tubular members $\mathbf{123}_1$–$\mathbf{123}_3$ (e.g., tubular member $\mathbf{123}_2$) includes a first aperture 124 and at least one tubular member $\mathbf{131}_1$-$\mathbf{131}_2$ (e.g., tubular member $\mathbf{131}_1$) includes a second aperture 133. Adapted to receive position mechanism 200 of FIG. 2, first aperture 124 provides a primary mechanism for adjustment and maintenance of the door in a stationary position through application of an additional frictional force against hinge pin 110 in a first rotational direction. The second aperture 133 is adapted to receive another position mechanism 300 (similar to position mechanism 200). This position mechanism 300 provides a frictional force in a second rotational direction which is generally opposite the first rotational direction. This would prevent a door from swinging open or closed from a set position due to various factors such as where the hinge pin becomes loose. A cross-sectional view of these position mechanisms 200 and 300 in relation to hinge pin represented by dashed lines is shown in FIG. 4.

Referring now to FIG. 5, a perspective view of a third exemplary embodiment of positioning door hinge 100 is described. Similar to FIGS. 1 and 3, positioning door hinge 100 includes hinge pin 110, first plate 120 including interspersed tubular members $\mathbf{123}_1$–$\mathbf{123}_n$ extending from longitudinal edge 122 and second plate 130 including interspersed tubular members $\mathbf{131}_1$–$\mathbf{131}_m$ extending from longitudinal edge 132. Herein, at least one of tubular members $\mathbf{123}_1$–$\mathbf{123}_n$ (e.g., tubular member $\mathbf{123}_1$) includes an aperture 125 and at least one of tubular member $\mathbf{131}_1$–$\mathbf{131}_m$ (e.g., tubular member $\mathbf{131}_1$) includes an aperture 133. While position mechanism 300 is inserted in aperture 133 and hinders movement of the door from a stationary position, aperture 125 simply provides for alignment of tubular members $\mathbf{123}_1$–$\mathbf{123}_n$ and $\mathbf{131}_1$–$\mathbf{131}_m$. Thus, a pin 400 may be permanently inserted into aperture 125 without effecting rotation of hinge pin 110.

Figure 6:
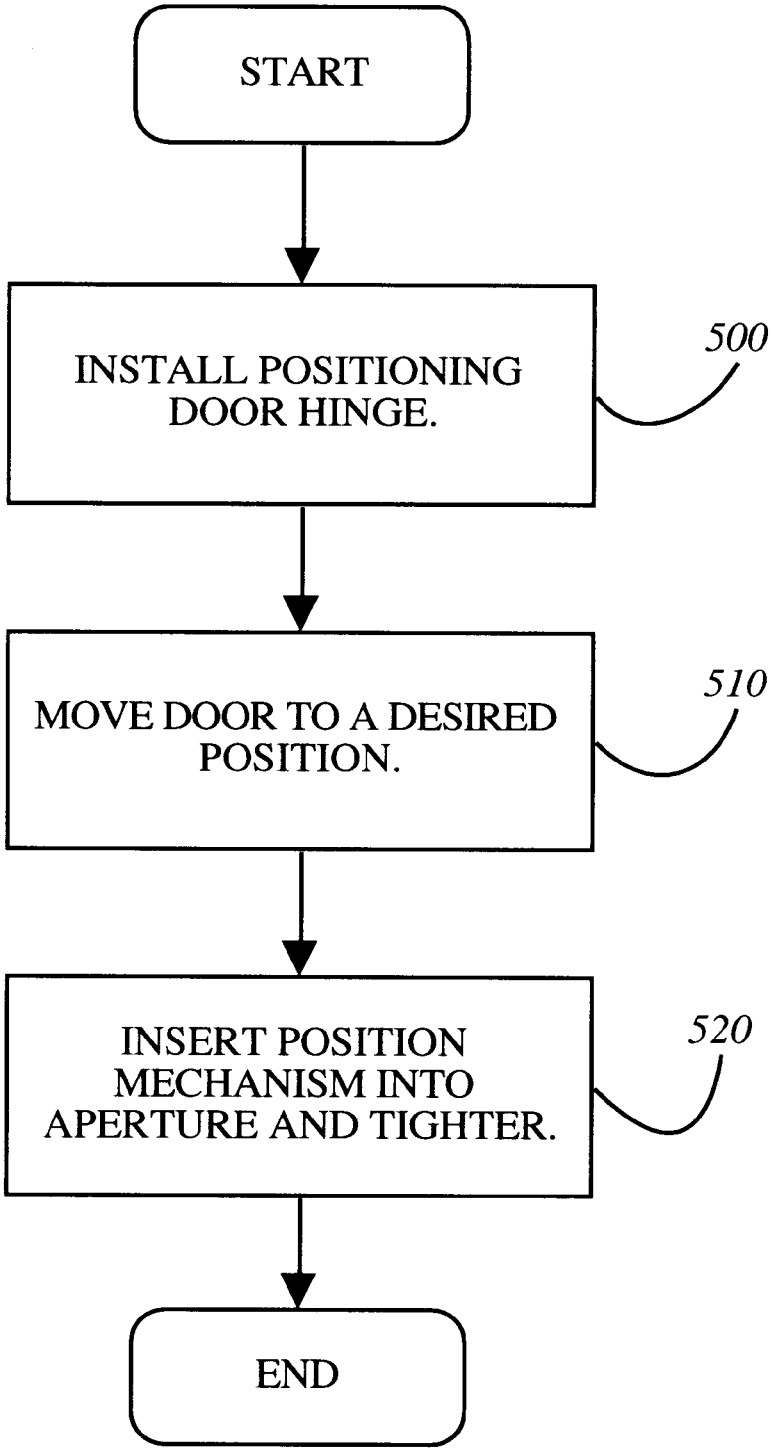
FIG. 6 is a flowchart illustrating the operations of the positioning door hinge of FIG. 2 or FIG. 4.

Referring now to FIG. 6, the operational steps performed in placing a door in a stationary position using the positioning door hinge is described. Initially, the positioning door hinge is installed (Step 500). Next, the door utilizing the positioning door hinge is moved to a desired stationary position (Step 510). Then, a position mechanism, inserted into an aperture set into a particular tubular member of the positioning door hinge, is sufficiently tightened to make contact with the surface of the hinge pin (Step 520). This contact would apply an additional frictional force against the hinge pin to maintain the door in its desired stationary position.

The present invention describe herein may be designed in many different configurations. While the present invention has been described in terms of various embodiments, other embodiments may come in mind to those skilled in the art without departing from the spirit and scope of the present invention. The invention should, therefore, be measured in terms of the claims which follow.

What is claimed is:

1. A door hinge comprising:

a first plate having at least two tubular members protruding from a longitudinal edge of the first plate;

a second plate including at least two tubular members protruding from a longitudinal edge of the second plate, the at least two tubular members including a selected tubular member having an aperture;

a removable hinge pin adapted for insertion through the tubular members of the first plate and the tubular members of the second plate so that the selected tubular member is adjacent to and interlocks with the tubular members of the first plate; and an insert having a first end and a second end, the first end of the insert including a non-metal pad resting flush against a convex surface of the hinge pin and the second end of the insert substantially flush with the selected tubular member of the second plate when the insert is inserted into the aperture to avoid contact between the insert and the first plate during rotation of either the first plate or second plate.

2. The door hinge of claim 1, wherein an area formed by the longitudinal edge of the first plate and edges of the tubular members of the first plate allow the insert, being sufficiently flush against the selected tubular member of the second plate, to avoid contact with the first plate during rotational movement of either the first plate or the second plate.

3. The door hinge of claim 2, wherein the aperture of the at least one tubular member of the second plate is pre-drilled and tapped threaded.

4. The door hinge of claim 1, wherein the insert frictionally resists closure of a door attached to one of the first and second plates.

5. A door hinge comprising:

a first plate having both a first and second tubular elements protruding from a longitudinal edge of the first plate by a predetermined distance;

a second plate having a third tubular member protruding from a longitudinal edge of the second plate;

a removable hinge pin to interlock the third tubular member of the second plate with the first and second tubular members of the first plate; and a first insert adapted for insertion into an aperture placed in the third tubular member, the first insert having a first non-metal end and a second end, the first end resting flush against the hinge pin to provide frictional forces in a first rotational direction and the second end substantially flush against the third tubular member of the second plate to avoid interference with the rotation of said first plate relative to said second plate.

6. The door hinge of claim 5, wherein the aperture of the third tubular member is pre-drilled and tapped threaded.

7. The door hinge of claim 5, wherein the first insert includes a cylindrical screw threshold corresponding to the aperture.

8. The door hinge of claim 5, wherein the second tubular member of the first plate further includes an aperture to receive a second insert to provide frictional forces in a second rotational direction directly opposite the first rotational direction.

* * * * *

UNITED STATES PATENT AND TRADEMARK OFFICE

CERTIFICATE OF CORRECTION

PATENT NO. : 5,966,778
DATED : October 19, 1999
INVENTOR(S) : Ray

It is certified that error appears in the above-identified patent and that said Letters Patent is hereby corrected as shown below:

Title page,
Item [74], *Attorney, Agent or Firm*, please delete "Zafmann" and insert -- Zafman --.

Signed and Sealed this

Fourteenth Day of September, 2004

JON W. DUDAS
*Director of the United States Patent and Trademark Office*